US008220722B1

(12) United States Patent
Shaffer

(10) Patent No.: US 8,220,722 B1
(45) Date of Patent: Jul. 17, 2012

(54) THERMAL SENSOR SHOWER MONITOR

(76) Inventor: Bruce Shaffer, Fall River, MA (US)

( * ) Notice: Subject to any disclaimer, the term of this patent is extended or adjusted under 35 U.S.C. 154(b) by 1252 days.

(21) Appl. No.: 11/581,162

(22) Filed: Oct. 12, 2006

(51) Int. Cl.
*G05D 23/00* (2006.01)
*G05D 23/13* (2006.01)

(52) U.S. Cl. ..... 236/94; 236/12.12; 137/624.22

(58) Field of Classification Search ..... 236/94, 236/12.1, 12.12; 4/605; 374/147; 137/624.22; 700/282; 29/729
See application file for complete search history.

(56) References Cited

U.S. PATENT DOCUMENTS

| | | | | |
|---|---|---|---|---|
| 3,859,644 | A | 1/1975 | Main | |
| 3,924,468 | A | 12/1975 | Persson | |
| 3,981,266 | A * | 9/1976 | Persson | 116/290 |
| 4,083,250 | A | 4/1978 | Goff et al. | |
| 4,743,120 | A | 5/1988 | Bowen | |
| 4,936,508 | A * | 6/1990 | Ingalz | 239/72 |
| 5,076,709 | A | 12/1991 | Tognotti | |
| 5,415,203 | A | 5/1995 | Huang | |
| 5,535,779 | A | 7/1996 | Huang | |
| 6,016,836 | A * | 1/2000 | Brunkhardt | 137/624.11 |
| 6,055,213 | A * | 4/2000 | Rubbo et al. | 367/82 |
| 6,286,764 | B1 * | 9/2001 | Garvey et al. | 236/12.12 |
| 6,814,486 | B2 * | 11/2004 | Sidoni | 374/208 |
| 7,124,452 | B1 * | 10/2006 | Bauza | 4/605 |
| 2002/0018401 | A1 | 2/2002 | Vassallo | |
| 2003/0112845 | A1 | 6/2003 | Kaiser et al. | |
| 2003/0125842 | A1 * | 7/2003 | Chang et al. | 700/282 |
| 2005/0016603 | A1 * | 1/2005 | Brunkhardt | 137/624.11 |

FOREIGN PATENT DOCUMENTS

| | | |
|---|---|---|
| EP | 841.546 | 5/1998 |
| GB | 830.721 | 3/1960 |
| GB | 2.408.826 | 6/2005 |
| JP | 54028599 | 3/1979 |

* cited by examiner

*Primary Examiner* — Chen Wen Jiang
(74) *Attorney, Agent, or Firm* — Salter & Michaelson

(57) ABSTRACT

The present invention relates to a shower monitor to alert a person how long they have been in the shower by emitting a short audible sound at preset intervals and by emitting a continuous audible sound when a preset time limit has been reached. The shower monitor is provided with security features to prevent unauthorized users from by passing the device. The monitor may have a liquid crystal display providing a visual indication of the time remaining. The monitor has a thermal sensor for activation of a timing cycle. The monitor may employ a flow sensor in combination with or in lieu of the thermal sensor for activation of the timing cycle.

19 Claims, 17 Drawing Sheets

THERMAL SENSOR SHOWER MONITOR

BACKGROUND OF THE INVENTION

1. Field of the Invention

The present invention relates generally to monitoring devices and, more specifically, to a shower monitor mountable to a pipe having a thermal sensor that actuates a preselected timing cycle which emits an audible tone at predetermined intervals until the timing cycle has expired whereupon a continuous tone is emitted until the thermal sensor is deactivated by a drop in the threshold temperature of the thermal sensor.

2. Description of the Prior Art

There are other timing devices designed for similar purposes. Typical of these is U.S. Pat. No. 3,859,644 issued to Main on Jan. 7, 1975.

Another patent was issued to Persson on Dec. 9, 1975 as U.S. Pat. No. 3,924,468. Yet another U.S. Pat. No. 3,981,266 was issued to Persson on Sep. 21, 1976 and still yet another was issued on Apr. 11, 1978 to Goff, et al. as U.S. Pat. No. 4,083,250.

Another patent was issued to Bowen on May 10, 1988 as U.S. Pat. No. 4,743,120. Yet another U.S. Pat. No. 5,076,709 was issued to Tognotti on Dec. 31, 1991. Another was issued to Huang on May 16, 1995 as U.S. Pat. No. 5,415,203 and still yet another was issued on Jul. 16, 1996 to Huang as U.S. Pat. No. 5,535,779.

Another patent application was published to Vassallo on Feb. 14, 2002 as U.S. Patent Application No. 2002/0018401. Yet another U.S. Patent Application No. US 2003/0112845 was published to Kaiser et al. on Jun. 19, 2003. Another patent was issued to Mingori on Mar. 16, 1960 as U.K. Patent No. GB830,721. Yet another Japan Patent No. JP54028599 was issued to Masatoshi on Mar. 3, 1979. Another was published to Saar on May 13, 1998 as European Patent Application No. EP 0 841 546 and still yet another was issued on Jun. 8, 2005 to Morris as U.K. Patent No. GB 2 408 826.

U.S. Pat. No. 3,859,644

Inventor: Duane C. Main

Issued: Jan. 7, 1975

A digital cooking timer responsive to the temperature of a cooking medium and incorporating minimum and maximum time decoders to insure that the cooking period is within a predetermined range is described. An interval timer sets up a counting period upon immersion of the product in the cooking medium but is inhibited from starting its counting function by the minimum time decoder until elapse of a fixed time period. After elapse of the fixed time period, the interval timer is enabled when and if the cooking medium reaches a predetermined temperature. The maximum time decoder provides an override control that energizes the control device after a fixed period in the absence of an energizing signal for the control device from the interval timer.

U.S. Pat. No. 3,924,468

Inventor: Russel C. Persson

Issued: Dec. 9, 1975

A shower safety comfort temperature guide for use with bathing showers and the like in a manner to assist an individual in pre judging the comfort zone of the water prior to bodily contact with the water, the guide intended to be attached to the shower head pipe immediately prior to the shower head in a manner to measure the temperature of the water flowing through the pipe and indicating such temperature on a color zone guide dial, the guide including a bimetallic temperature responsive element for sensing the temperature change and connected through a gear mechanism to an indicator for indicating such temperature on the dial face.

U.S. Pat. No. 3,981,266

Inventor: Russell C. Persson

Issued: Sep. 21, 1976

A shower safety comfort temperature guide for use with bathing showers and the like in a manner to assist an individual in pre judging the comfort zone of the water prior to bodily contact with the water, the guide intended to be attached to the shower head pipe immediately prior to the shower head in a manner to measure the temperature of the water flowing through the pipe and indicating such temperature on a color zone guide dial, the guide including a bimetallic temperature responsive element for sensing the temperature change and connected through a gear mechanism to an indicator for indicating such temperature on the dial face U.S. Pat. No. 4,083,250

Inventor: Randall Goff et al.

Issued: Apr. 11, 1978

A portable food thermometer affording an audible alarm at a preset cooking completion temperature. A water reservoir defined within a two-part housing is fillable by the user in advance of use. An elongated sensing probe insertable in the food is secured extending through one of the housing parts inward of the reservoir and contains a slideable rod supported on a confined temperature sensing material. Expansion of the sensing material in response to increasing food temperature forces the rod outward of the probe. Opposite the free end of the rod is a spring loaded ball valve sealing the reservoir from a whistle outlet. Temperature graduations on the housing enable adjusting the spacing between the rod and valve at room temperature for presetting the operating temperature of the unit. On reaching set point cooking temperature, the outwardly forced position of the rod acts to open the valve enabling steam in the reservoir to activate the whistle alarm. When the alarm is activated, a plug positioned in the whistle outlet is displaced outwardly for affording a visual indication of thermometer operation.

U.S. Pat. No. 4,743,120

Inventor: John G. Bowen

Issued: May 10, 1988

A simple and inexpensive water temperature sensor that may be mounted on existing water faucets or showers to provide a ready visible indication of the temperature of the water flowing through the faucet or shower. The temperature sensor comprises an outer transparent tube mounted coaxially with the pipe leading to the faucet or shower head, a number of o-rings mounted within the tube and spaced along the length of the tube to form different compartments along the sensor, and a number of differently colored tubular members respectively forming a second wall for the compartments, with each compartment being filled with a material, such as paraffin wax, with the material in each compartment melting at a different temperature from the material in the other compartments, to become transparent and reveal the corresponding colored inner tubular member, when the water flowing to the faucet or shower has a particular temperature.

U.S. Pat. No. 5,076,709

Inventor: William M. Tognotti

Issued: Dec. 31, 1991

A shower flange thermometer includes a circular casing having a planar front face, the center of the front face forming a circular pipe-receiving aperture. Inside the casing is a thermometer having a temperature-sensitive foot adjacent to the aperture for transferring heat from and to the shower pipe. A transparent window in the face displays temperatures of the shower water as indirectly indicated by the temperature of the pipe.

U.S. Pat. No. 5,415,203

Inventor: L. S. Huang

Issued: May 16, 1995

A pipe, which includes a plurality of transparent sections and a plurality of opaque sections alternatively connected in series, the opaque sections being made in multiple colors, the transparent sections having temperature display chips which change color when the inside temperature of the pipe is changed over a fixed range.

U.S. Pat. No. 5,535,779

Inventor: Lung-Shen Huang

Issued: Jul. 16, 1996

A faucet or shower head includes a transparent zone on the casing thereof through which the color and quality of the water may be visually checked. A temperature display chip is mounted within the transparent zone and is covered with a transparent protective covering. The temperature display chip detects and displays the temperature of the water passing through the faucet or shower head. If the water temperature exceeds a predetermined value, a temperature controlled integrated circuit (IC) is activated to automatically give an audio alarm. This alarm helps prevent users from being scalded with excessively hot water.

U.S. Patent Application Number US 2002/0018401

Inventor: Stephen Vassallo

Published: Feb. 14, 2002

A device for timing the cooking of a food item, comprising timing means, apt to compute a cooking time interval, signaling means, actuatable by the timing means to signal that the time interval has elapsed, and temperature sensitive means, apt to be arranged in proximity of the food item and to determine the starting of computing of the time interval by the timing means at a pre-determined temperature.

U.S. Patent Application Number US 2003/0112845

Inventor: Dolores Kaiser et al.

Issued: Jun. 19, 2003

The present invention is a temperature measuring device for insertion into food which audibly signals the user when the temperature of the food reaches a predetermined level. The stem of the device contains a coiled temperature sensitive bi-metallic spring. As the internal temperature of the substance increases, the temperature sensing material slowly rotates, causing a pointer and triggering disk to rotate. When the rotation achieves a predetermined position, a pre-wound coil spring is permitted to engage a drive gear which operates a hammer device so as to provide an audible signal. Thus, the user is audibly alerted when the internal temperature of the substance reaches the desired threshold level.

U.K. Patent Number GB830,721

Inventor: Cesar Mingori

Issued: Mar. 16, 1960

A thermometer 4, for indicating the temperature of fluid contained in a pipe, is supported so as to lie wholly within the pipe, which has a transparent observation section inserted therein. The transparent section 1 is adapted to be secured by fittings 3 to the remainder of the piping 2. The arrangement may form part of a shower apparatus in which hot and cold water are piped separately and mixed by a control valve.

Japan Patent Number JP54028599

Inventor: Shimura Masatoshi

Issued: Mar. 3, 1979

To secure alarming at all times after a certain time lapse even in case the detector has some fault or malfunction, by installing a timer along with the water level/temperature detector.

European Patent Application Number EP 0 841 546

Inventor: David A. Saar

Issued: May 13, 1998

A system is disclosed for monitoring the use of water in an individual unit of a multi-unit building wherein the multi-unit building is supplied water from a common source (10) and the individual unit has a plurality of water consuming structures each supplied by one or a pair of water pipes (15) supplied from the common source. A monitor (19) determines the volumetric flow through each of the pipes, each of said monitors, and periodically transmits a signal encoded with the volumetric flow of the pipe and the identification of the individual unit in which the pipe is located. A remote receiver receives the encoded signals from each of the monitors and computes a total volumetric flow of water for the individual unit for a selected period of time. Additionally, continuous volumetric flow through the pipe proximate the water consuming structure during a predetermined period of time can be predetermined time so that an alarm signal can be transmitted in the event that it is determined that flow to the water consuming structure has been continuous for the predetermined time. The use of heat energy in the water devices can be monitored to define the heat energy use. The remote receiver receives the encoded signals from each of the monitors, defines a total volumetric flow of water and/or total heat energy use for the individual unit for a selected period of time, computes a water consumption/heat energy charge and prepares and forwards a bill to the individual unit.

U.K. Patent Number GB 2 408 826

Inventor: Phillip Ian Morris

Issued: Jun. 8, 2005

A water-temperature-sensing alarm, contained within a buoyant vessel, that comprises of appropriate electronic components, powered by battery(ies), which can carry out a series of bath-water-temperature tests to give an audible and visible indication. From a stand-by mode, the device will detect its presence in a conductive fluid (bathwater in this case), apply electrical power to other components on the circuit board, and emit an appropriate sound and light sequence. Temperature probes set in the vessel will detect the temperature of the water and instigate another appropriate sound and light sequence. If the water temperature is at an optimum temperature, the sound and light sequence will continue during the time the temperature remains at optimum. If the temperature rises above the optimum a louder sound, and more intensive light sequence, is emitted to provide a warning to the responsible person/guardian/parent that the other person in, or about to be placed in, the bath-water could be in danger of suffering scald burns. The alarm device can also be programmed to detect the temperature of water below a given temperature and emit an audible and visible alarm sequence to warn the responsible person/guardian/parent that the person in the bath-water could be in some discomfort or even in danger of suffering from hypothermia. Once removed from the bath-water the device detects the absence of conductive fluids and reverts to a stand-by mode.

While these timing sensing devices may be suitable for the purposes for which they were designed, they would not be as suitable for the purposes of the present invention, as hereinafter described.

SUMMARY OF THE PRESENT INVENTION

A primary object of the present invention is to provide a thermal sensor that monitors shower pipe temperatures.

Another object of the present invention is to provide a thermal sensor that monitors shower pipe temperatures incorporating temperature sensor for initiating a timing and alarm cycle.

Yet another object of the present invention is to provide a timer including cycle time usage alarm and continuous alarm when timing cycle terminates.

Still yet another object of the present invention is to provide a timer incorporating means for engaging a pipe, LCD display, timer adjustment buttons, and pass code protection buttons.

Additional objects of the present invention will appear as the description proceeds.

The present invention overcomes the shortcomings of the prior art by providing a shower monitor mountable to a pipe having a thermal sensor that actuates a preselected timing cycle which emits an audible tone at predetermined intervals until the timing cycle has expired whereupon a continuous tone is emitted until the thermal sensor is deactivated by a drop in the threshold temperature of the thermal sensor.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 10:
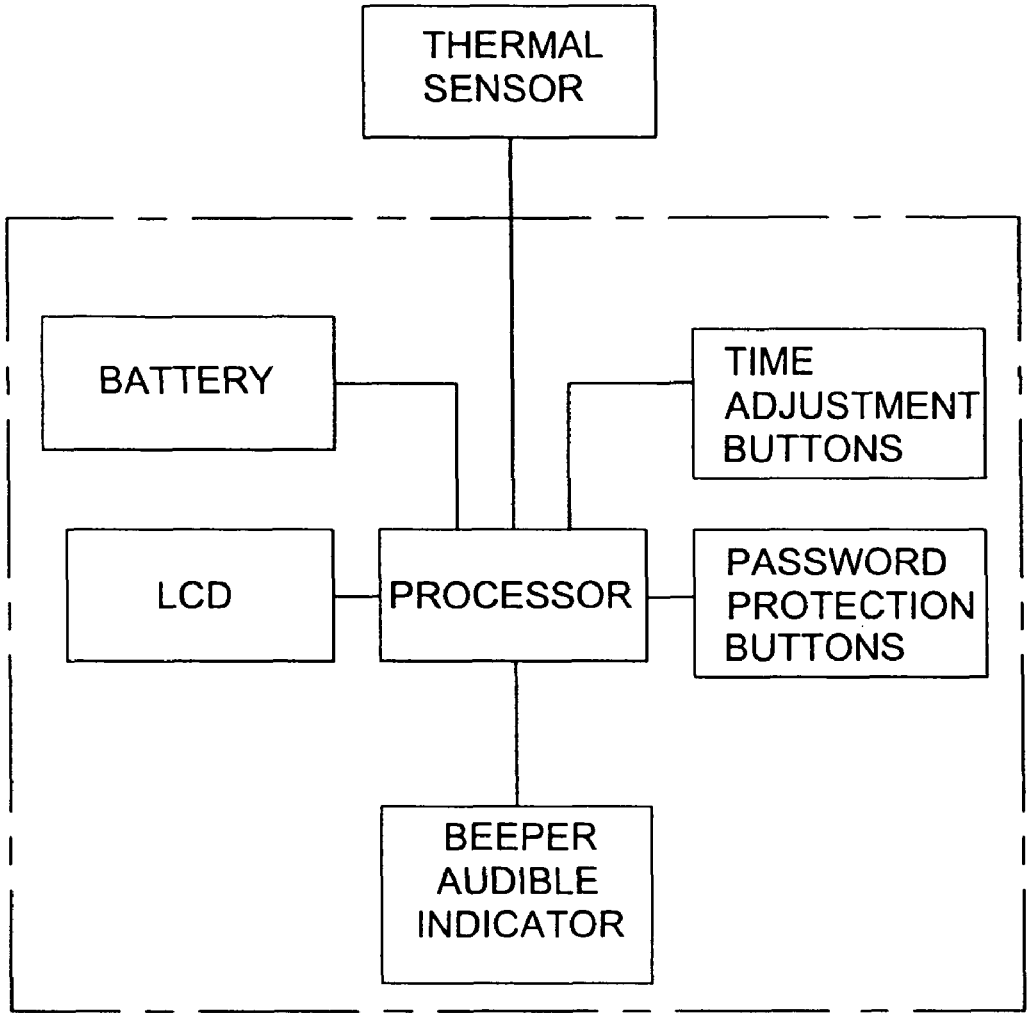
Figure 10A:
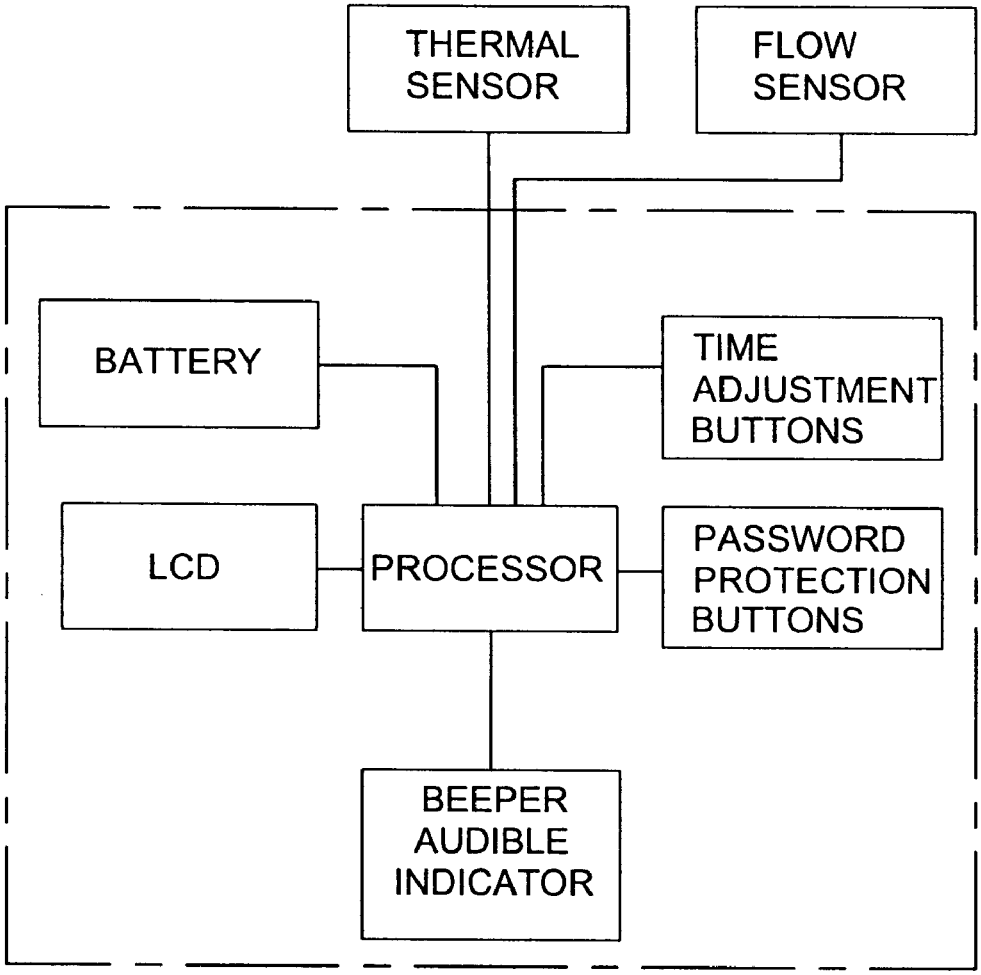
Figure 10B:
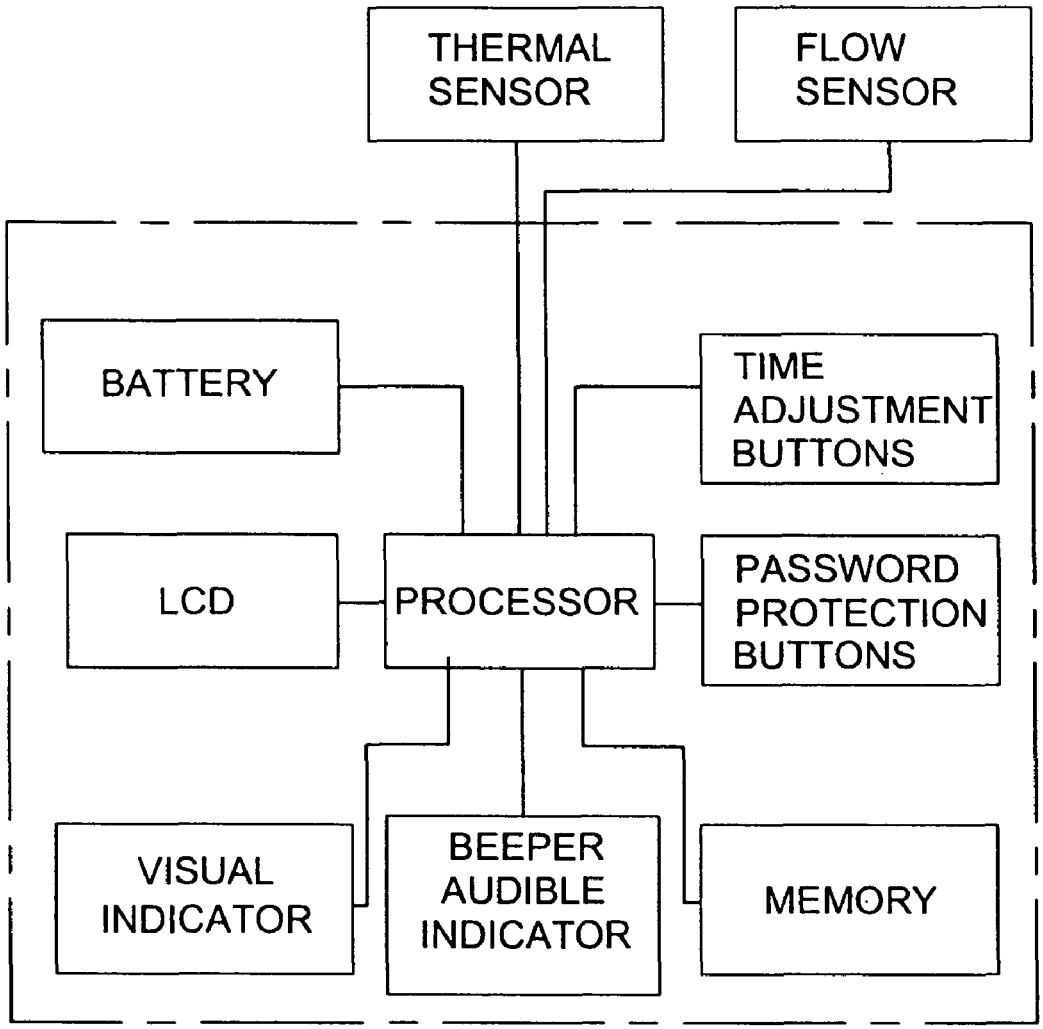

FIGS. 10, 10A, and 10B are connection diagrams of the present invention.

Figure 11:
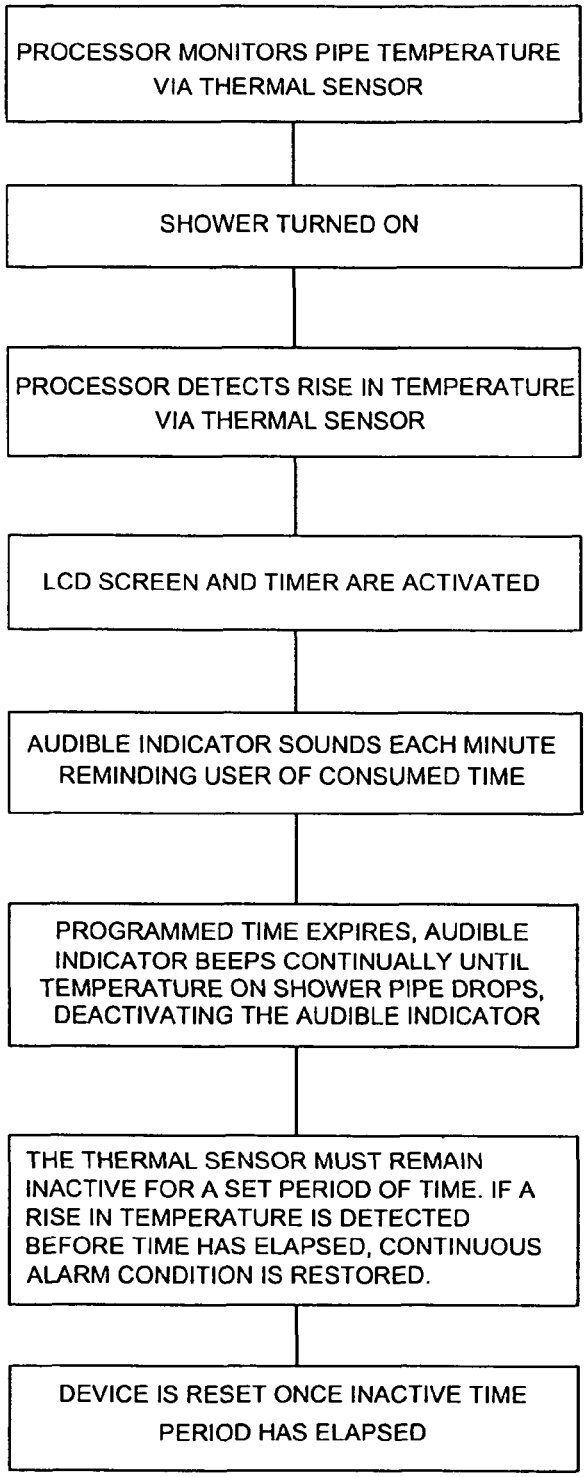

FIG. 11 is a logic diagram of the present invention.

LIST OF REFERENCE NUMERALS

With regard to reference numerals used, the following numbering is used throughout the drawings.

| | |
|---|---|
| 10 | Present Invention |
| 12 | Housing |
| 14 | Thermal Sensor |
| 16 | Liquid Crystal Display |
| 18 | Clamp |
| 20 | Security Fastener |
| 22 | Audible Indicator |
| 24 | Battery |
| 26 | Time Adjustment Buttons |
| 28 | Password Control Buttons |
| 30 | Processor |
| 32 | Timer |
| 34 | Flow Sensor |
| 36 | Pipe |
| 38 | Shower Head |
| 40 | Visual Indicator |
| 42 | Memory |
| 44 | Connection Jack |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
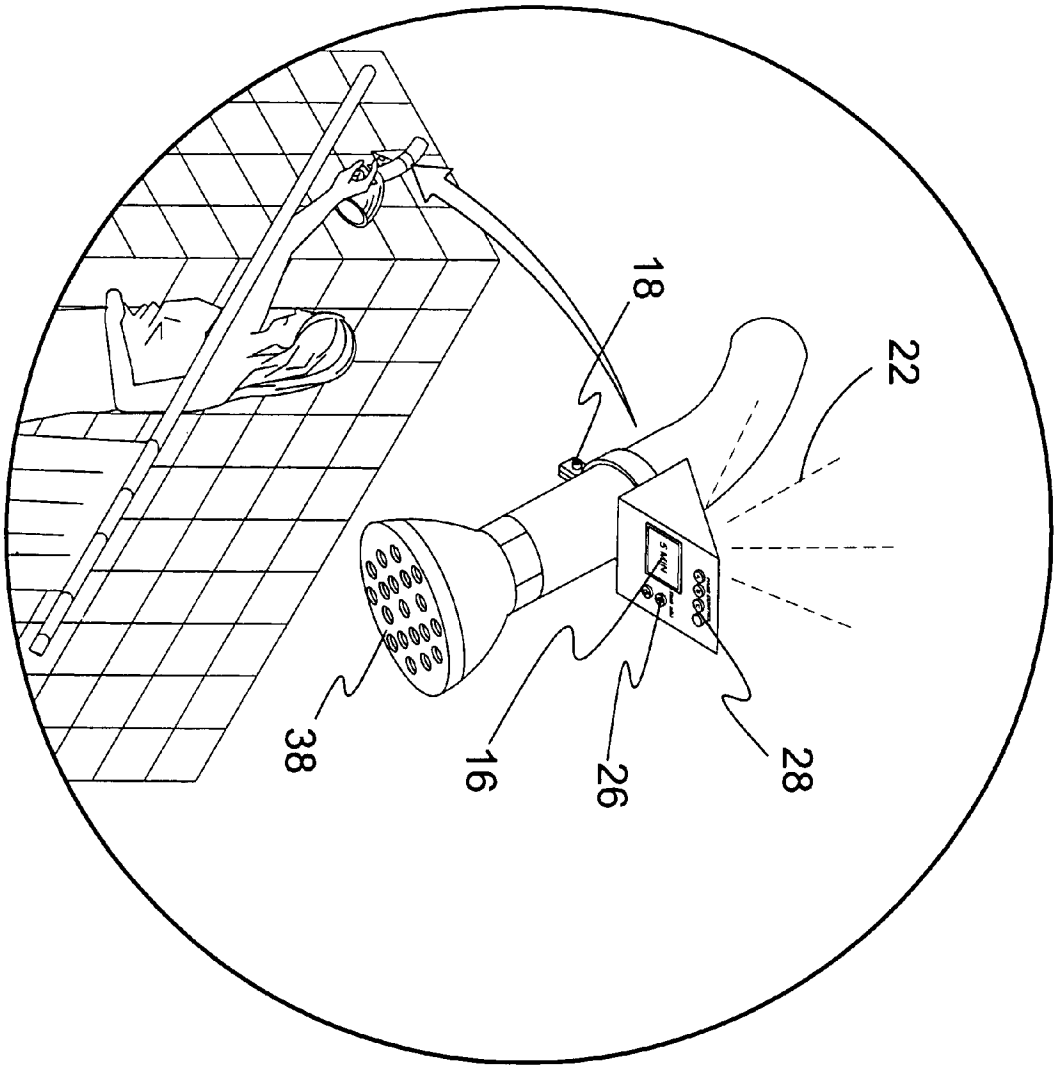
FIG. 1 is an illustrative view of the present invention in use.
Figure 2:
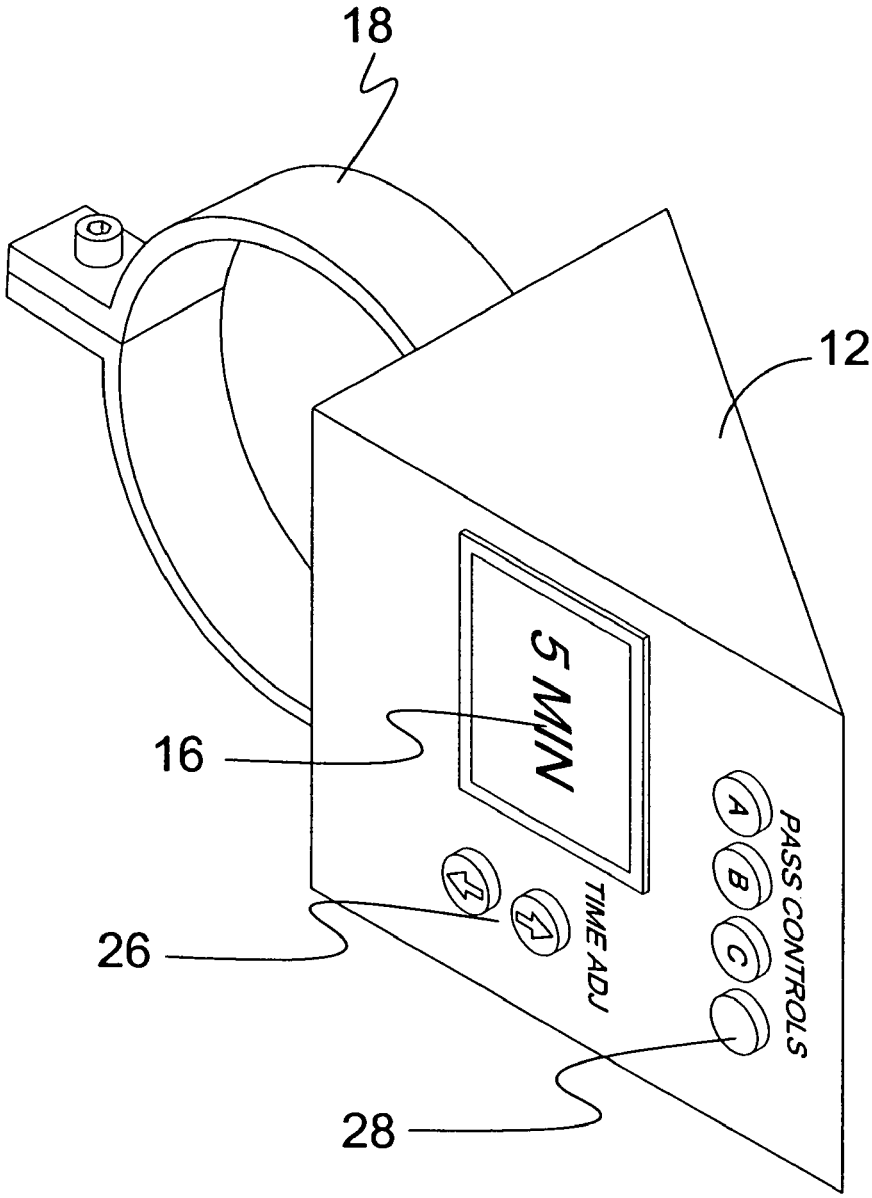
FIG. 2 is a perspective view of the present invention.

FIG. 1 is an illustrative view of the present invention 10 in use. The present invention 10 is a shower monitor to alert a person how long they have been in the shower by emitting a short audible sound at preset intervals and by emitting a continuous audible sound when a preset time limit has been reached indicating that is time turn the shower off. The shower monitor is provided with password protection and a security or anti-tampering fastener to prevent unauthorized users from by passing the device.

Figure 9:
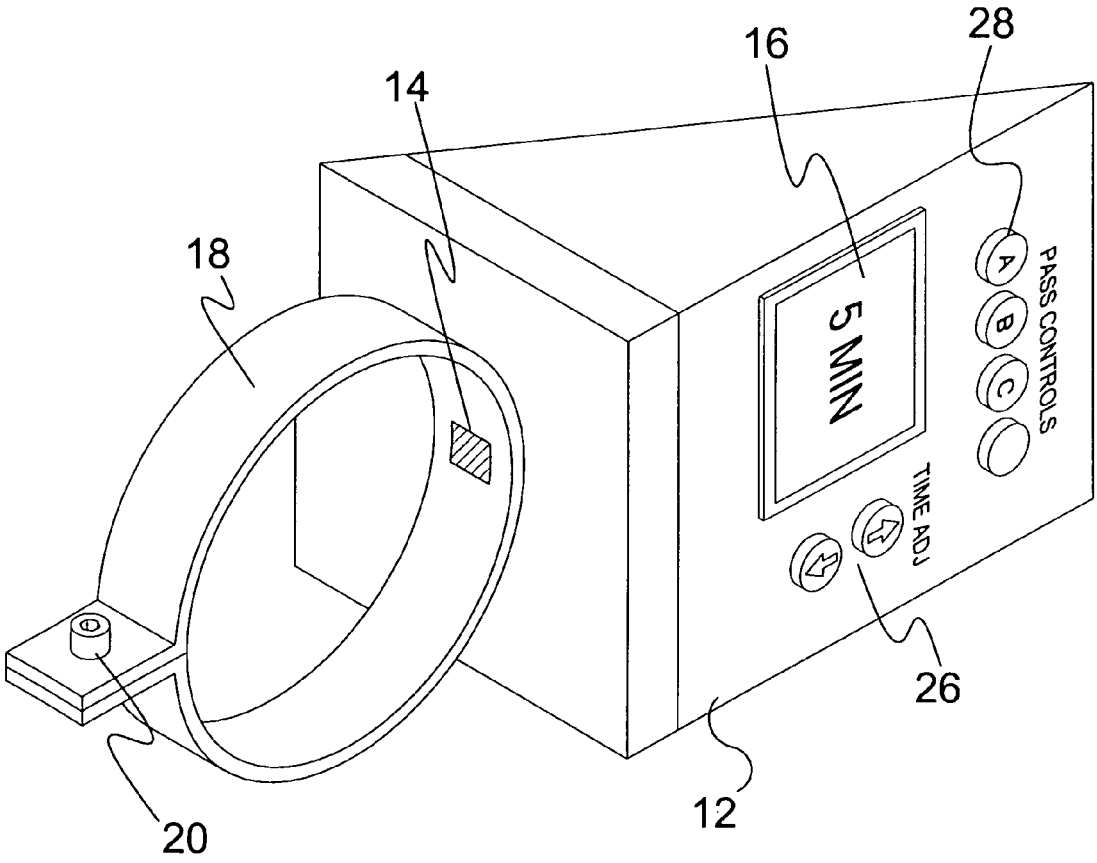
FIGS. 9 and 9A are perspective views of the present invention.

The shower monitor of the present invention 10, as seen in FIGS. 2-9, incorporates a housing 12 in which the elements of the monitor are located or attached to, and a clamp 18 secured to housing 12 for attachment of the monitor to a pipe 36. The elements in the housing 12 include a thermal sensor 14, a liquid crystal display (LCD) 16, audible indicator 22, a battery 24, time adjustment buttons 26, password protection buttons 28, and a processor 30. FIG. 10 shows one possible way in which these elements may be interconnected in the housing. The thermal sensor 14 activates the monitor and starts the count down of the timing cycle. Preferably the thermal sensor 14 is positioned to be in direct contact with the pipe 36 on which the shower monitor is mounted. The clamp 18 as seen in FIG. 9, will be provided with a through hole in which the thermal sensor 14 may rest to ensure direct contact between the thermal sensor 14 and the pipe 36. The thermal sensor 14 may also be positioned to be in direct contact with the clamp 18 instead of the pipe 36. If the sensor is in contact with only the clamp 18, then the clamp 18 should be made of a metal such as aluminum or steel, which will readily transmit the heat from the pipe 36 through the clamp 18 to the thermal sensor 14. The LCD 16 may indicate the preset time limit prior to the beginning of the timing cycle and then the LCD 16 may display the remaining time once the timing cycle has begun. The timer 32 provides the LCD with the required display information. One possible logic flow for the present invention is seen in FIG. 11. The processor 30 monitors the thermal sensor 14. After the user turns on the shower and the processor determines that the temperature at the thermal sensor is at or above the threshold temperature the processor then activates the timer 32 and the LCD 16. The threshold temperature is between 85 and 120 degrees. It is preferable the threshold temperature is above room temperature to prevent the monitor from accidentally activating. It is preferable that the threshold temperature is below 98 degrees so that a user cannot take a luke warm shower where the monitor does not activate. The timer 32 begins the timing cycle, which counts down from the preset time to zero in one-second intervals. The processor 30 monitors the count down and sends a sign to the audible indicator 22 so that a short sound such as a beep is emitted to alert the user each time a predetermined time interval has passed. Preferably these would be one-minute intervals but they can be short as one second or as long as the preset time for the continuous alarm or any time in between. The preset time for the continuous audible alarm may typically be set for any time between one and sixty minutes. If a longer time is desired, the timer may be provided that is capable of timing up to 24 hours or more if needed. Once the processor 30 has determined the time has elapsed, a continuous signal will be sent to the audible indicator 22 so that a continuous alarm is emitted. The continuous alarm is silenced when the processor 30 has determined that the temperature reading from the thermal sensor 14 has dropped below the threshold temperature. The processor 30 continues to monitor the thermal sensor 14, and if there is a temperature rise within a specific period of time after the continuous alarm has silenced, the processor 30 will reactivate the continuous alarm. This is to discourage a user from turning off the shower for a short period of time to reset the monitor. Typically this time period is between five to ten minutes. It may be set to a shorter or longer time. It has to be long enough to discourage a user from waiting for the monitor to rest to continue for a longer shower. Once the processor 30 has determined that the temperature at the thermal sensor 14 has remained below the threshold temperature for the specified time period then the processor 30 will rest the timer 32, turn off the LCD 16, and continue to monitor the thermal sensor 14. The LCD 16 is turned off to conserve power. The monitor may be programmed so when one of the buttons is pressed the LCD 16 will activate and show the preset time limit and or the time interval. The time adjustment buttons 26 allow the user to change the preset time limit and the time interval once the proper password has been entered. The password protection buttons 28 allow a user to enter the password and set the password for the monitor.

Figure 9A:
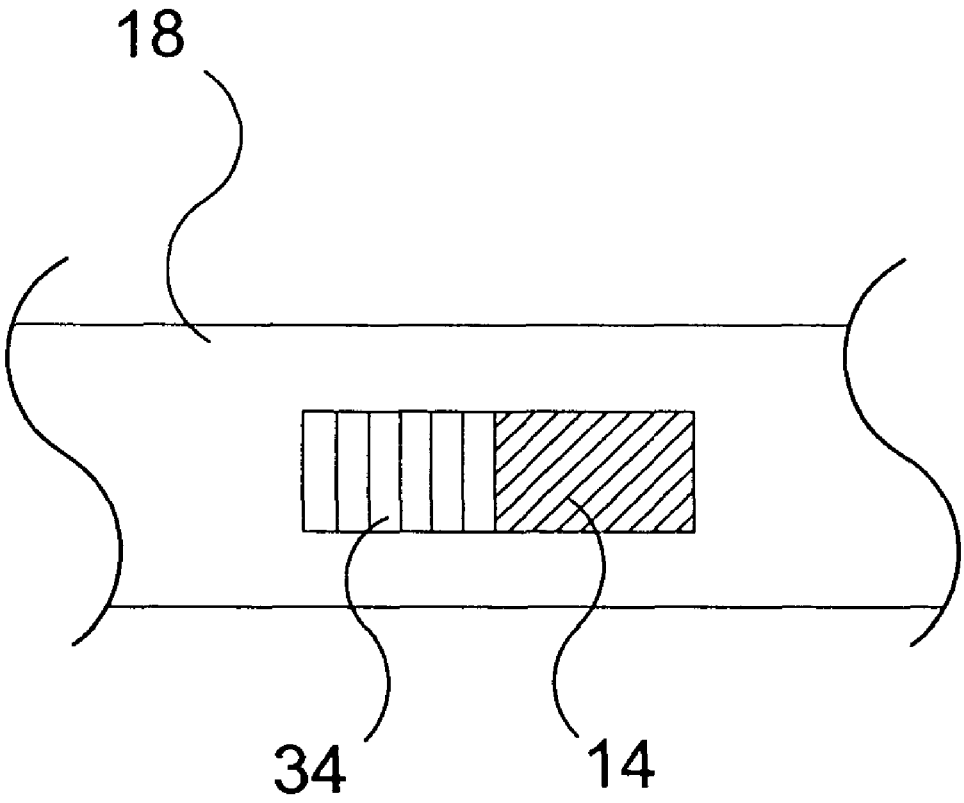

The monitor of the present invention 10 may be employed on any pipe where it is desired to reduce water usage or to provide a reminder to turn off a watering device such as a lawn or garden sprinkler. To provide the additional function the monitor may employ a flow sensor 34 in combination with or in lieu of the thermal sensor 14. The flow sensor is connected to the processor as seen in FIG. 10A. Preferably the flow sensor 34 is positioned in a through hole in the clamp 18 adjacent the thermal sensor 14 as seen in FIG. 9A so that the flow sensor 34 is in contact with the pipe 36. The flow sensor 34 may positioned to be in contact with only the clamp 18 where the clamp is made from a metal such as aluminum or steel. With a flow sensor 34 only, the monitor will count down upon detection of water flow. With both sensors a simple hot, cold programming step will allow the user to monitor hot or cold water flow. The addition of a flow sensor 34 will prevent a user from letting the shower run at a temperature just under the threshold temperature. The flow sensor 34 may be employed to turn off the continuous alarm quickly once the user has turned off the shower. The flow sensor 34 is helpful since the pipe 36 may continue to be above the threshold temperature for some time after the hot water flow has stopped. The flow sensor 34 will eliminate the need for a user to run cold water to turn off the alarm prior to shutting of the shower. The flow sensor 34 may also be employed during the preset time period after the continuous alarm has been silenced and before the monitor has reset. If flow is detected during this time period, the processor 30 will restore the continuous alarm. The flow sensor 34 will provide a more rapid response than the thermal sensor 14. The thermal sensor 14 is also important due to the fact that it may take some time for a user to actually get hot water at the showerhead. For the above noted reasons it is preferable that a monitor employ both a thermal sensor 14 and a flow sensor 16. When the monitor (with both sensors) is set to monitor hot water flow the timer 32 will activate based upon the thermal sensor 14. The timing cycle will not begin until the user receives hot water. When the monitor (with both sensors) is set for cold water the timer 32 will activate on the flow sensor 34.

Figure 3:
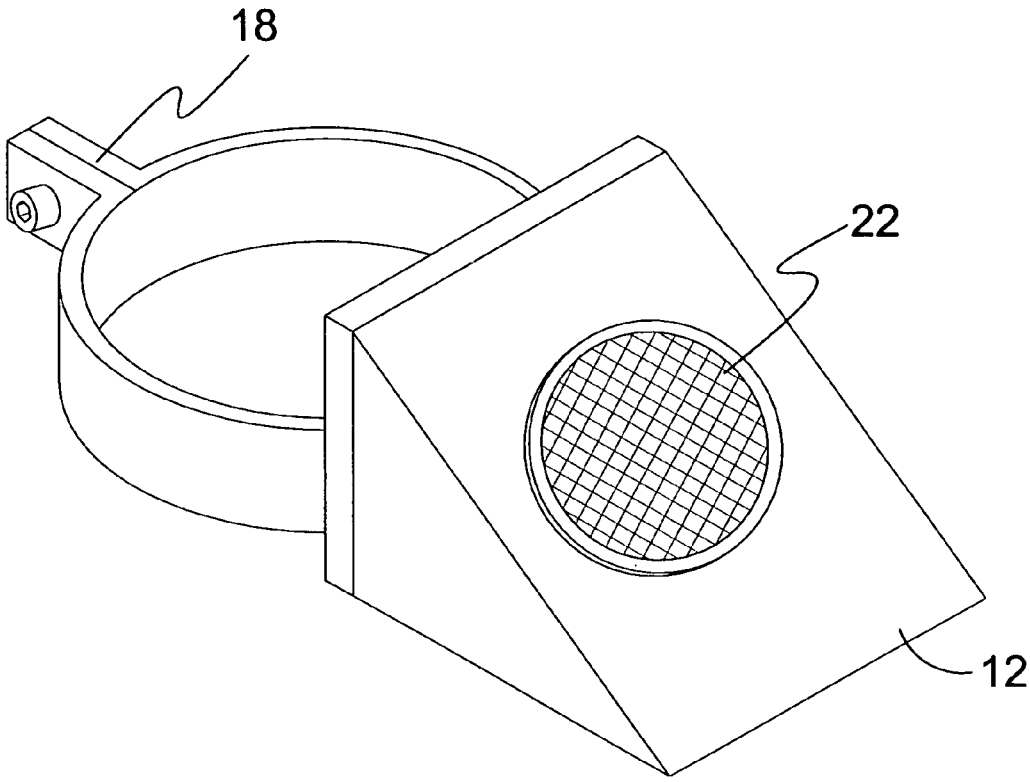
FIGS. 3 and 3A are rear views of the present invention.
Figure 3A:
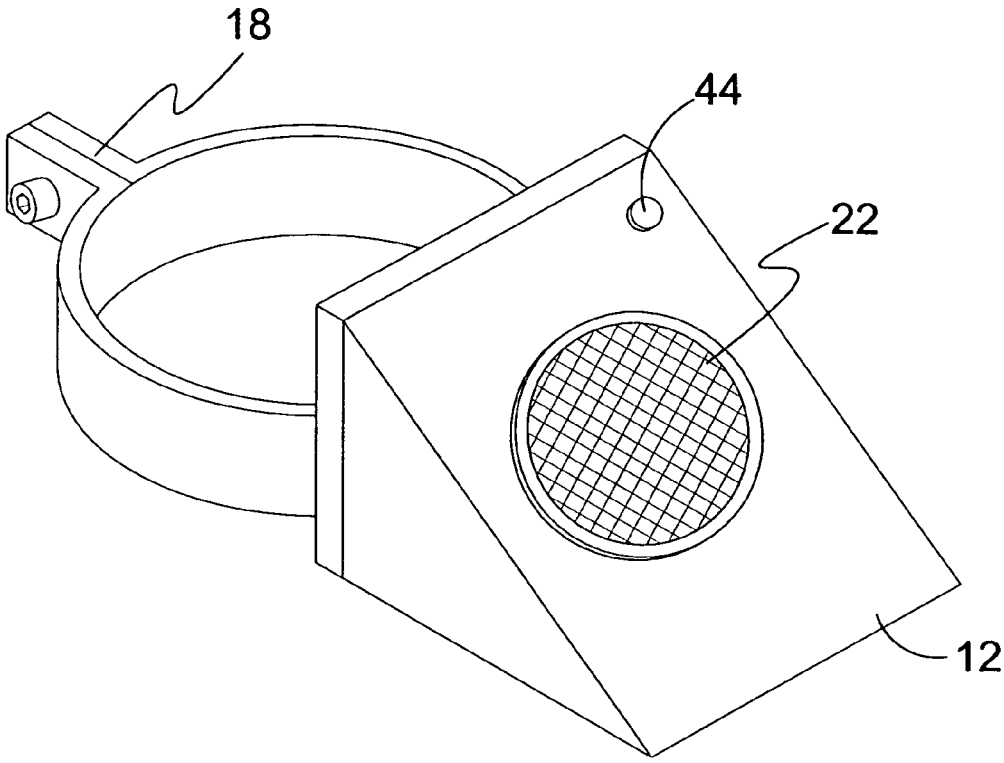
Figure 4:
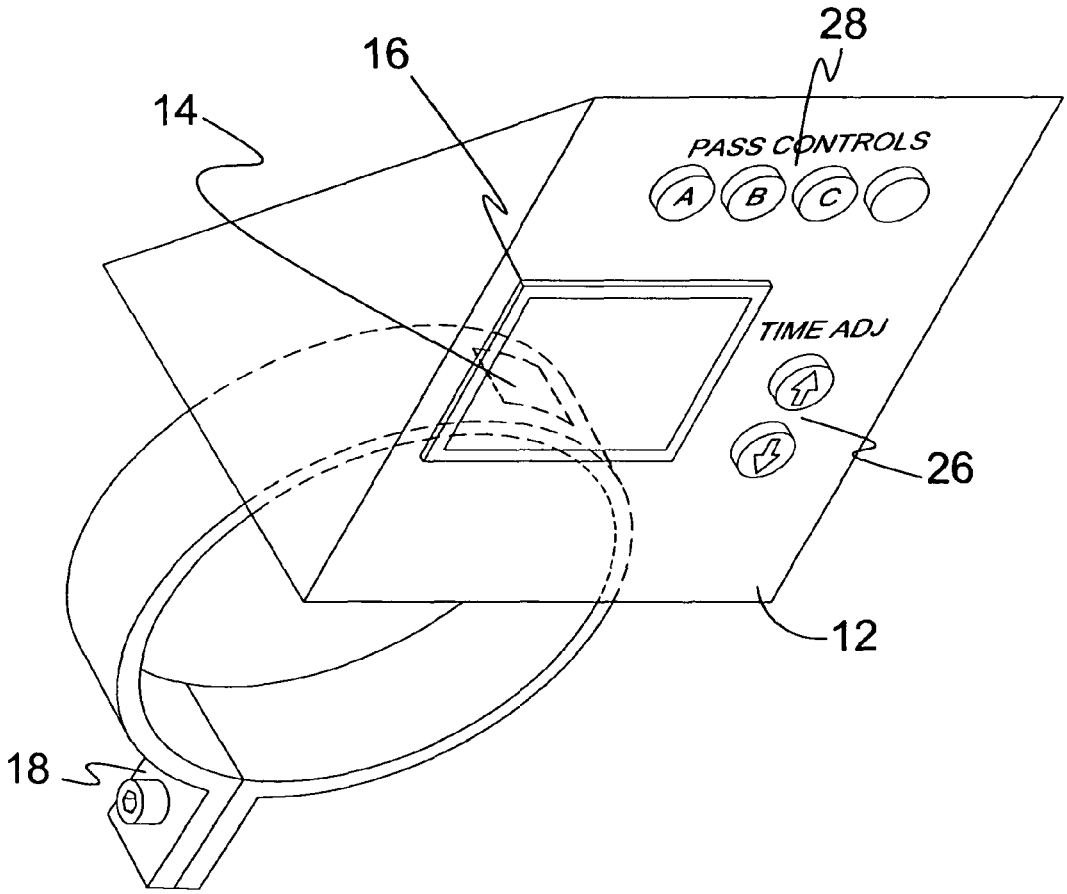
FIG. 4 is an illustrative view of the present invention.
Figure 5:
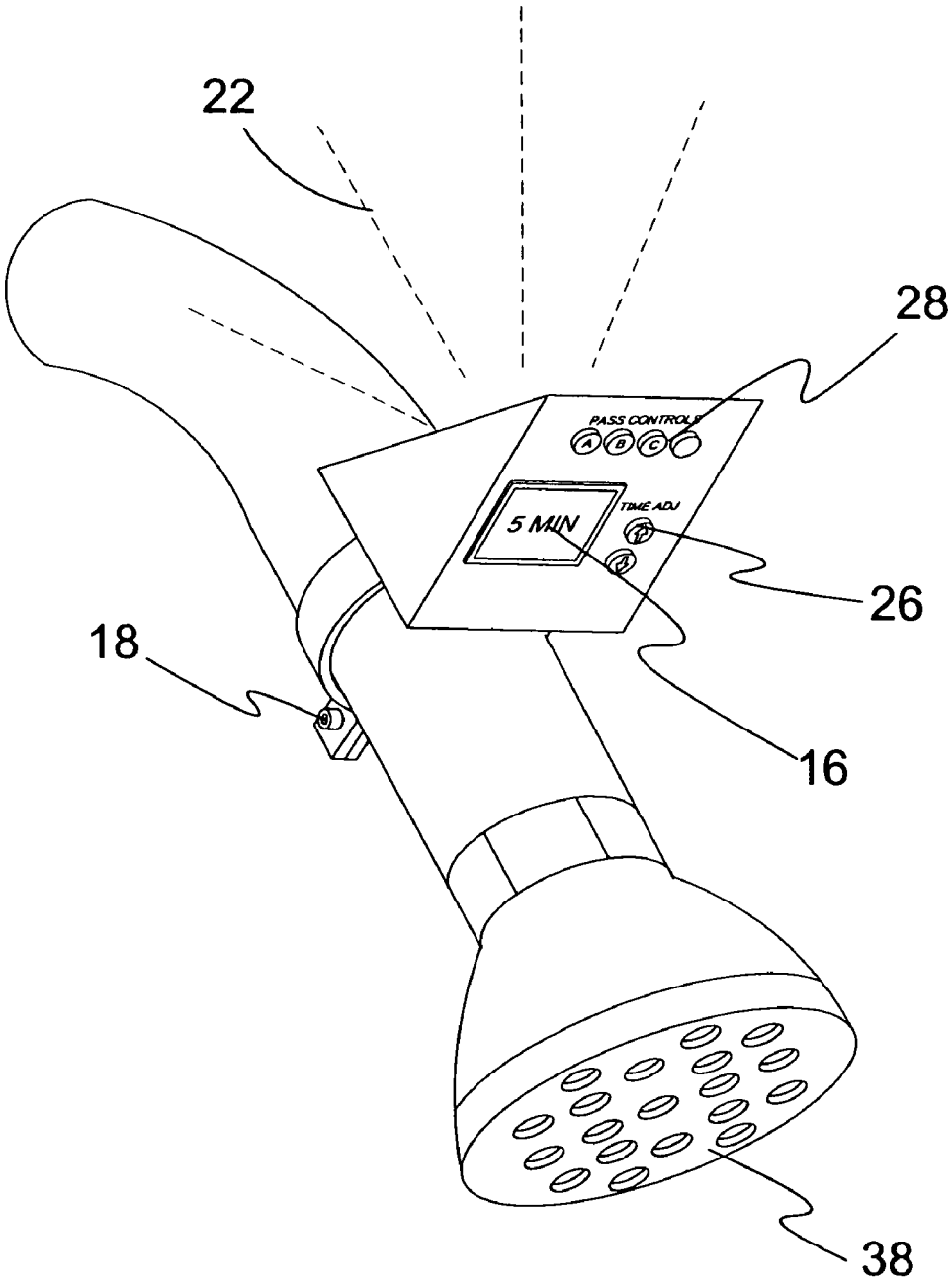
FIG. 5 is a perspective view of the present invention.
Figure 6:
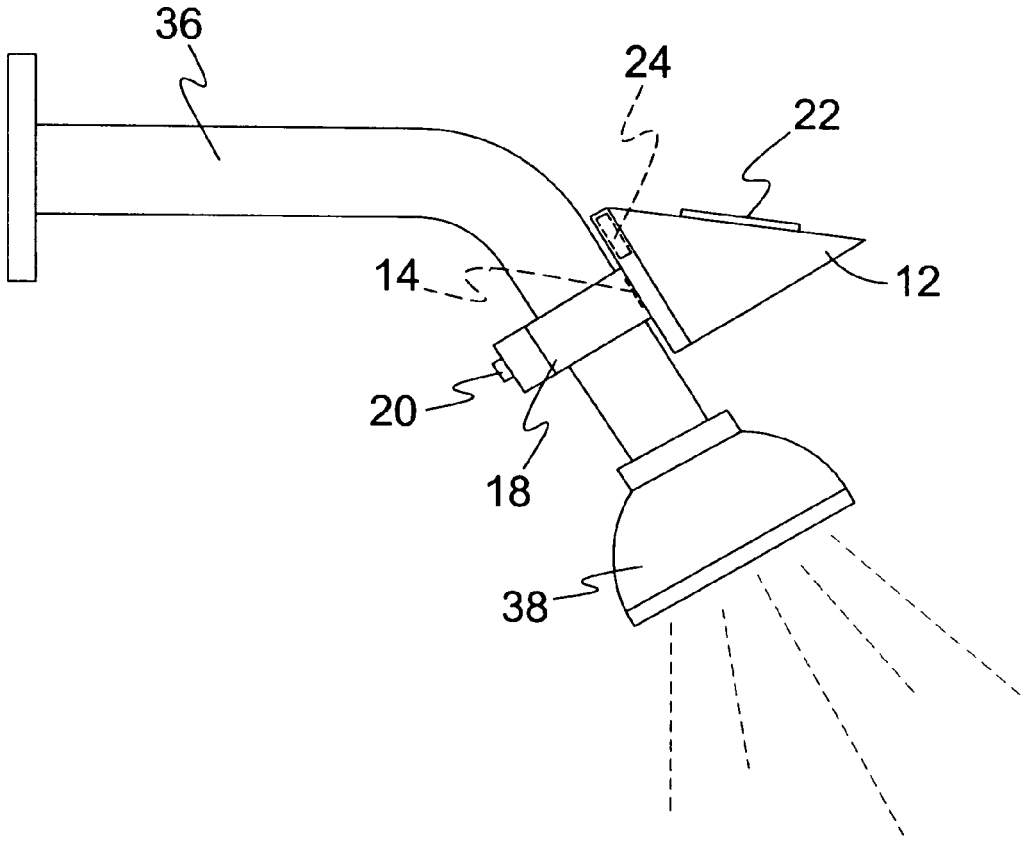
FIG. 6 is a side view of the present invention assembled to shower pipe.
Figure 7:
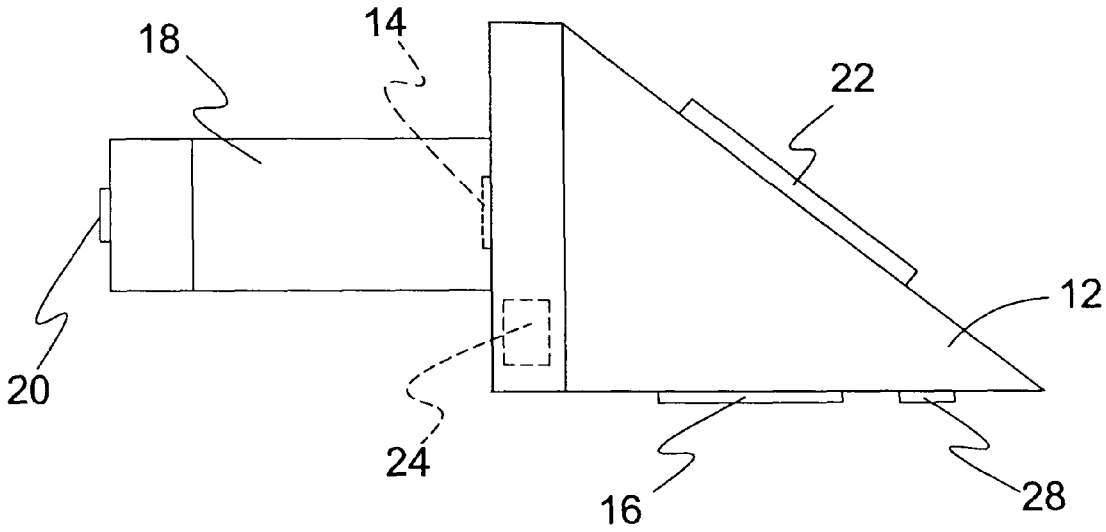
FIGS. 7 and 7A are side views of the present invention.
Figure 7A:
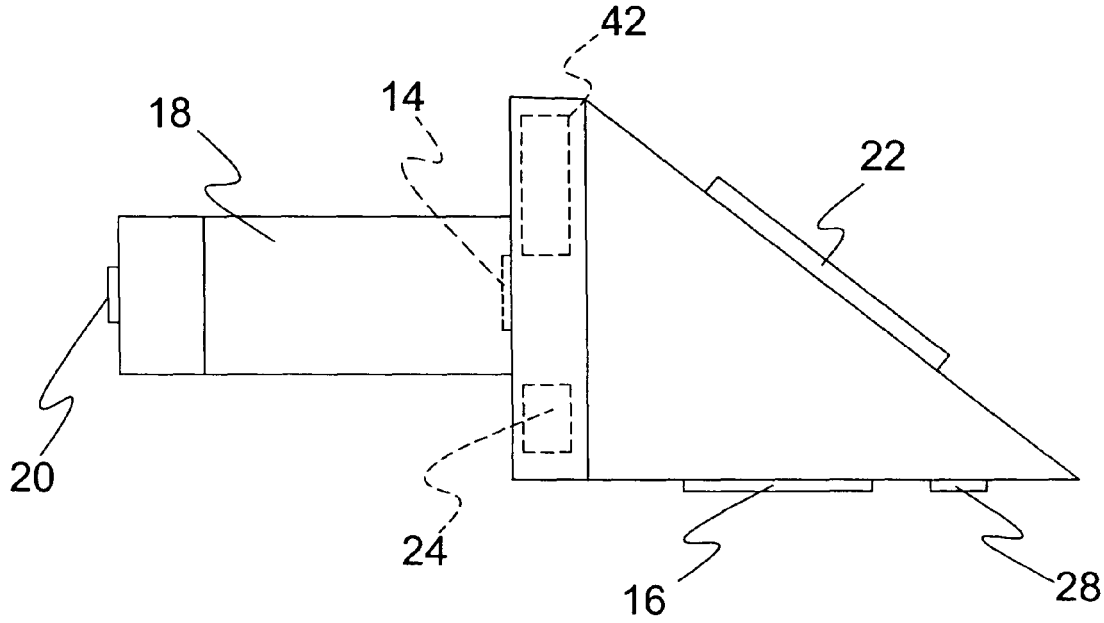
Figure 8:
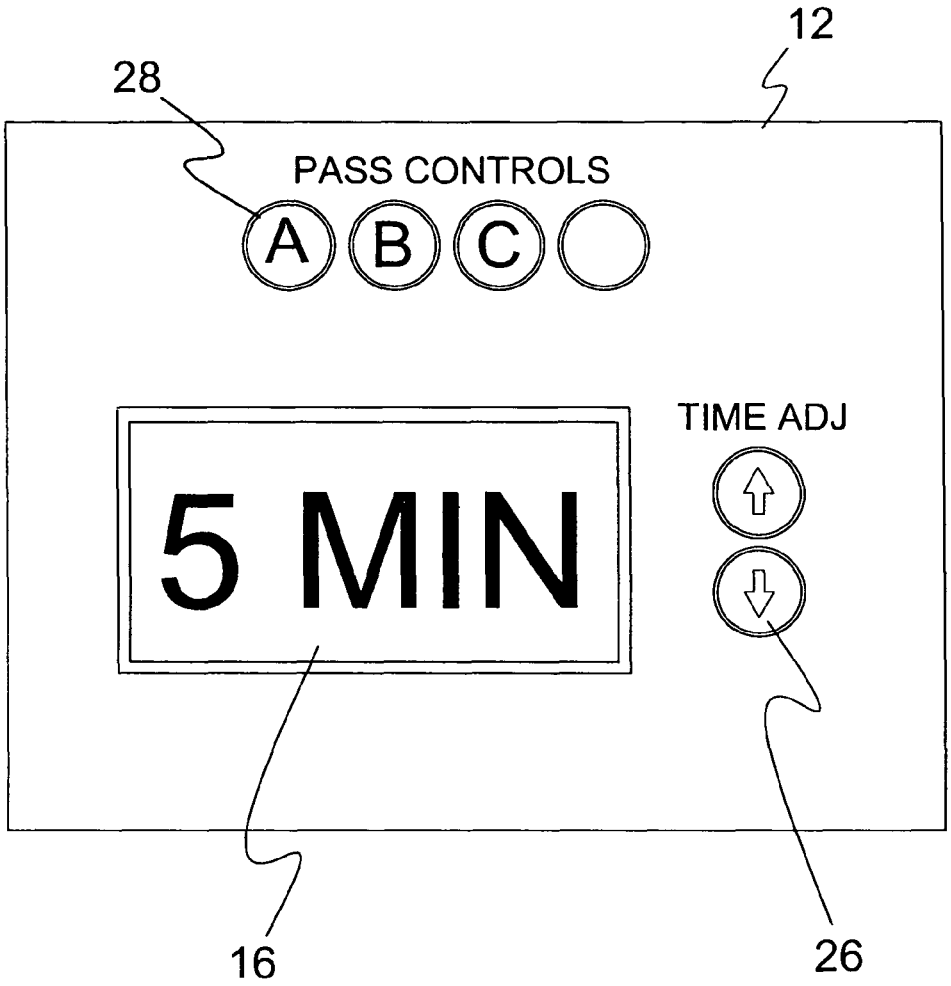
FIGS. 8 and 8A are frontal views of the present invention
Figure 8A:
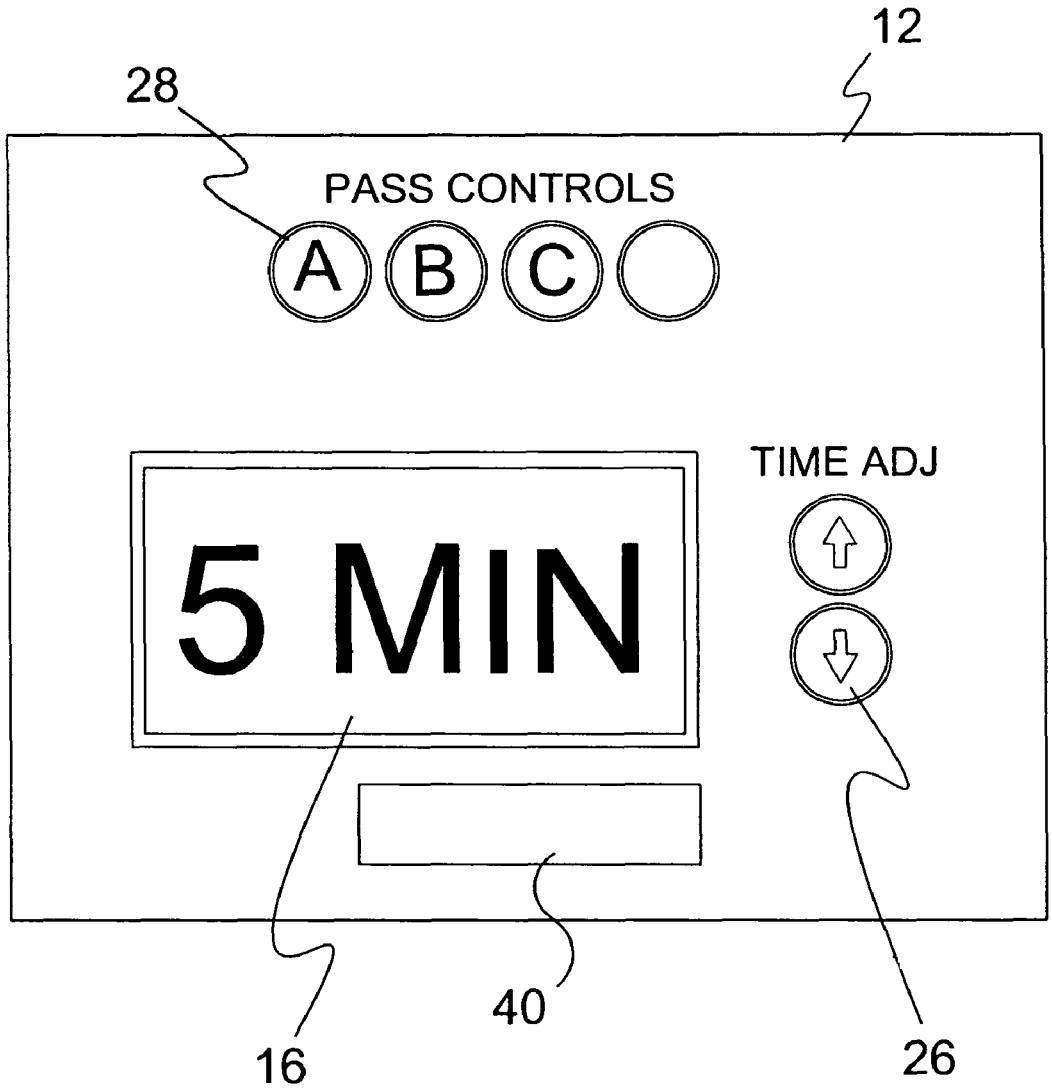

The monitor may be provided with a visual indicator 40 such as a flashing light for users that are hearing impaired. The visual indicator is connected to the processor as seen in FIG. 10B. The visual indicator may be mounted adjacent the LCD 16 as seen in FIG. 8A. The monitor may employ memory 42 for storing usage data to allow the user to monitor water usage over a period of time as seen in FIGS. 7A and 10B. The monitor may also be provided with a connection jack 44 for connecting the monitor to a computer for downloading the water usage information as seen in FIG. 3A. The monitor may be provided with an internal clock so that on and off times and the associated date can be recorded. The monitor may also be provided with a silent mode where there is no audible or visual alarm so that the device becomes a data-gathering device. The monitor could retain and record usage information to determine water usage in situation where there is a single water meter and multiple water users. The data could an employed to determine usage volume employing simple fluid mechanics, such as pipe size, pressure, and the time duration of the flow. The monitor may be programmed with the pipe size, pressure so that usage is determined and recorded. The monitor may be provided with a single set of adjustment buttons for entering the password and adjusting the timer.

I claim:

1. A shower monitor for attachment to a pipe, the shower monitor comprising:

a housing, a clamp for securing the housing to an exterior surface of the pipe, a thermal sensor for determining when a threshold temperature has been reached, said clamp having a through bore positioned under said housing, said thermal sensor positioned in said through bore in said clamp so that said sensor directly contacts the pipe when the clamp is mounted on the pipe, a liquid crystal display, an audible indicator, adjustment buttons, a battery, a processor, and a timer, wherein the liquid crystal display is for displaying a preset time, wherein the timer begins a countdown from the present time to zero once the sensor has reached the threshold temperature, wherein a short alarm is emitted from the audible indicator each time a predetermined time interval has been reached, wherein a continuous alarm is emitted from the audible indicator once the timer has reached zero, the adjustment buttons allow the user to secure the device with a password to prevent unauthorized changing of the monitor settings, and the adjustment buttons allow the user to adjust the preset time and the time interval once the password has been correctly entered, wherein the continuous alarm terminates once the thermal sensor indicates a temperature below the threshold temperature, wherein the monitor has a flow sensor for determining the start and the stoppage of water flow in the pipe, said flow sensor being positioned in said through bore so that said flow sensor is in direct contact with the pipe when the clamp is mounted on the pipe.

2. The shower monitor of claim 1, wherein the clamp has an anti-tampering fastener for securing the clamp about the pipe.

3. The shower monitor of claim 1, wherein the monitor has a clock for indicating time and date and the liquid crystal display is capable of displaying the time and date, the preset time, and the time interval.

4. The shower monitor of claim 3, wherein the monitor has memory for recording usage data, the data including the time and date water flow started, the time and date water flow stopped, and total water flow time.

5. The shower monitor of claim 4, wherein the monitor has a visual alarm for indicating the preset time has elapsed.

6. The shower monitor of claim 5, wherein the visual alarm is a flashing light.

7. The shower monitor of claim 1, wherein the threshold temperature is between 85 degrees and 120 degrees Fahrenheit.

8. The shower monitor of claim 1, wherein the monitor has memory for recording usage data, the data including the time and date water flow started, the time and date water flow stopped, and total water flow time.

9. The shower monitor of claim 8, wherein the monitor has a visual alarm for indicating the preset time has elapsed.

10. The shower monitor of claim 9, wherein the visual alarm is a flashing light.

11. A water flow monitor for attachment to a pipe, the water flow monitor comprising:

a housing, a clamp for securing the housing to an exterior surface of the pipe, a thermal sensor for determining when a threshold temperature has been reached, said clamp having a through bore positioned under said housing, said thermal sensor positioned in said through bore in said clamp so that said sensor directly contacts the pipe when the clamp is mounted on the pipe, a liquid crystal display, an audible indicator, adjustment buttons, a battery, a processor, and a timer, wherein the liquid crystal display is for displaying a preset time, wherein the timer begins a countdown from the present time to zero once the sensor has reached the threshold temperature, wherein a short alarm is emitted from the audible indicator each time a predetermined time interval has been reached, wherein a continuous alarm is emitted from the audible indicator once the timer has reached zero, the adjustment buttons allow the user to secure the device with a password to prevent unauthorized changing of the monitor settings, and the adjustment buttons allow the user to adjust the preset time and the time interval once the password has been correctly entered, wherein the continuous alarm terminates once the thermal sensor indicates a temperature below the threshold temperature, wherein the monitor has a clock for indicating time and date and the liquid crystal display is capable of displaying the time and date, the preset time, and the time interval, and wherein the monitor has a flow sensor for determining the start and the stoppage of water flow in the pipe, said flow sensor positioned in said throughbore of said clamp so that said flow sensor is in direct contact with the pipe when the clamp is mounted on the pipe.

12. The water flow monitor of claim 11, wherein the clamp has an anti-tampering fastener for securing the clamp about the pipe.

13. The water flow monitor of claim 11, wherein the threshold temperature is between 85 degrees and 120 degrees Fahrenheit.

14. The water flow monitor of claim 11, wherein the monitor has memory for recording usage data, the data including the time and date water flow started, the time and date water flow stopped, and total water flow time.

15. The water flow monitor of claim 14, wherein the monitor has a visual alarm for indicating the preset time has elapsed.

16. The water flow monitor of claim 15, wherein the visual alarm is a flashing light.

17. The water flow monitor of claim 11, wherein the monitor has memory for recording usage data, the data including the time and date water flow started, the time and date water flow stopped, and total water flow time.

18. The water flow monitor of claim 17, wherein the monitor has a visual alarm for indicating the preset time has elapsed.

19. The water flow monitor of claim 18, wherein the visual alarm is a flashing light.

* * * * *